US007146892B2

(12) United States Patent
Kienzle et al.

(10) Patent No.: US 7,146,892 B2
(45) Date of Patent: Dec. 12, 2006

(54) CUTTING INSTALLATION WITH TWO GRIPPER BEAMS DISPLACEABLE IN OPPOSITE DIRECTIONS

(75) Inventors: Roland Kienzle, Ohlsbach (DE); Franz Hagle, Offenburg (DE); Olaf Zeiss, Herholzheim (DE)

(73) Assignee: Parker Hannifin GmbH (DE)

( * ) Notice: Subject to any disclaimer, the term of this patent is extended or adjusted under 35 U.S.C. 154(b) by 333 days.

(21) Appl. No.: 10/825,937

(22) Filed: Apr. 16, 2004

(65) Prior Publication Data

US 2004/0250669 A1 Dec. 16, 2004

(30) Foreign Application Priority Data

Apr. 16, 2003 (DE) ..... 103 17 834

(51) Int. Cl.
*B26D 7/06* (2006.01)
*B26D 5/20* (2006.01)
*B65H 20/24* (2006.01)

(52) U.S. Cl. ..... 83/153; 83/206; 83/277; 83/282; 226/112

(58) Field of Classification Search ..... 83/153, 83/206, 277, 282, 151; 226/112; 271/268, 271/85

See application file for complete search history.

(56) References Cited

U.S. PATENT DOCUMENTS 3,819,073 A * 6/1974 Asselborn et al. ..... 414/431
6,092,709 A * 7/2000 Schoenbeck et al. ..... 226/112

FOREIGN PATENT DOCUMENTS

| | | |
|---|---|---|
| DE | 7140571 | 10/1971 |
| DE | 4124810 A1 | 1/1993 |
| DE | 20007207 U1 | 9/2000 |

* cited by examiner

*Primary Examiner*—Kenneth E. Peterson
*Assistant Examiner*—Isaac N. Hamilton
(74) *Attorney, Agent, or Firm*—Christopher H. Hunter

(57) ABSTRACT

A cutting installation for a fabric web comprising an unwinding unit, a downstream dancer unit serving as a buffer, and a downstream cutting frame with a cutting unit disposed thereon. At least two gripper beams extending parallel to the cutting unit and guided along a lateral rail arrangement are displaceable across the longitudinal extension of the cutting frame, and each gripper beam on one side is carried by a first support tower which is displaceable along the rails, and on its opposite end is provided with a telescopically extendable extension piece. The extension piece can be docked with a second support tower arranged on the opposite side and traveling along. The support towers are adapted for adjusting the height of the respectively carried gripper beam, such that each gripper beam, as it moves along the cutting frame, can travel over the other gripper beam.

11 Claims, 2 Drawing Sheets

CUTTING INSTALLATION WITH TWO GRIPPER BEAMS DISPLACEABLE IN OPPOSITE DIRECTIONS

CROSS REFERENCE TO RELATED APPLICATIONS

This application claims priority to German Patent Application 10317834.1, filed Apr. 16, 2003.

BACKGROUND OF THE INVENTION

The invention relates to a cutting installation for a fabric web comprising an unwinding unit, a downstream dancer unit serving as a buffer, and a downstream cutting frame with a cutting unit arranged thereon. A gripper beam extending parallel to the cutting unit can be displaced across the longitudinal direction of the cutting frame along laterally extending rails.

Such a cutting installation, which is known through prior use, has only one gripper beam, which can be displaced across the length of the cutting frame between a front position and a rear position. The gripper beam in its front position uses suitable pickup means to grasp the end of the fabric web buffered in the dancer unit and pulls the web across the cutting table by moving along the rails mounted on the cutting frame. The gripper beam stops in the cutting position because, based on conventional cutting technology, the fabric can be cut only when stationary. Subsequently the gripper beam transports the cut piece of fabric web to a delivery stack located below the cutting frame. Thereafter, the gripper beam returns to its front position for the next cycle. The drawback of the known machine arrangement is that the required unproductive return stroke of the gripper beam limits the capacity of the cutting installation despite relatively high traveling speeds of the gripper beam.

The object of the invention is to increase the capacity of a cutting installation with the initially described features. This object as well as advantageous embodiments and further refinements of the invention are described in the claims, which follow this description.

SUMMARY OF THE INVENTION

The invention, in its basic concept, provides a cutting installation of the above described type, in which at least two gripper beams can be displaced along the cutting frame and each gripper beam is carried on one side by a first support tower that can be displaced along the rails and at its opposite end has a telescopically extendable extension piece, which can be docked with a second support tower that travels along and is arranged on the opposite side. The support towers are adapted for adjusting the height of the gripper beam supported by them, such that each gripper beam, during its movement along the cutting frame, can travel over the other gripper beam.

This arrangement of two gripper beams, which can be displaced along the cutting frame independently from each other and without mutually influencing each other, makes possible a clear reduction in the cutting cycle time because the second gripper beam can already travel back to pick up the end of the fabric web while the first gripper beam is in its cutting/unwinding stage. To that extent, the two gripper beams work in a continuous alternating cycle. Any mutual interference of their displacement movements is excluded because, on the one hand, the gripper beams are height-adjustable, so that they can travel over or under each other.

On the other hand, since the corresponding support towers must also travel past each other in the rail area, the invention provides for an axial extension means for the corresponding gripper beam to ensure the required compensation in length for the connection with an associated outer support tower.

One embodiment of the invention provides that the gripper beam, when in its lowered position, rests with its end opposite the first support tower carrying it on a slide traveling along. This support enables a precise positioning of the gripper beam for grasping the end of the fabric web.

Another embodiment provides that with respect to the arrangement of the gripper beam, the first and second support towers and the slides assigned to each of the two gripper beams are disposed laterally reversed to each other on opposite sides of the cutting table. For this purpose it may be provided that three rails each are disposed on the two sides of the cutting frame, receiving, respectively, a first support tower, a second support tower, and a slide.

According to exemplary embodiments of the invention, the slides are each displaceable on the innermost rails and the first support towers carrying the associated gripper beams on the center rails, while the second support towers, adapted for docking with the extension piece of the corresponding gripper beam, are displaceable on the outermost rails.

The first and second support towers each have a lifting device for moving the gripper beams carried by them between a lowered position and a raised position.

The two support towers and/or the ends of the extendable extension pieces have a docking device for detachably connecting the support towers with the extension pieces. One embodiment of the invention provides that the docking device of each second support tower is a pin protruding in axial direction of the gripper beam. The corresponding extension piece of the gripper beam is provided with a bore at its end to mate with the pin for a positive connection.

If due to the increased cycle times and the greater unwinding speed of the fabric web from the dancer unit serving as the buffer, the dancer unit is subject to increased stress, one embodiment of the invention provides that the dancer unit be improved by making the controlled input tension of the dancer unit adjustable.

To the extent that, in the cutting installations according to the prior art, the dancer unit is constructed of a number of fixed first deflection rollers and a number of second deflection rollers, which are supported in a slide that is movable in relation to the fixed deflection rollers, the input tension in the known cutting installations was controlled only by the weight of the slide and the second deflection rollers supported therein. At high unwinding speeds, however, the slide, due to its inherent inertia, does not follow the changing unwinding conditions fast enough with an unwinding of the fabric web from the dancer unit and a short standstill. Hence, another embodiment of the invention provides that the movable slide can be displaced by means of a motor, such that a controlled input tension for the web can be adjusted via the motor.

DETAILED DESCRIPTION OF THE PREFERRED EMBODIMENT

Figure 1:
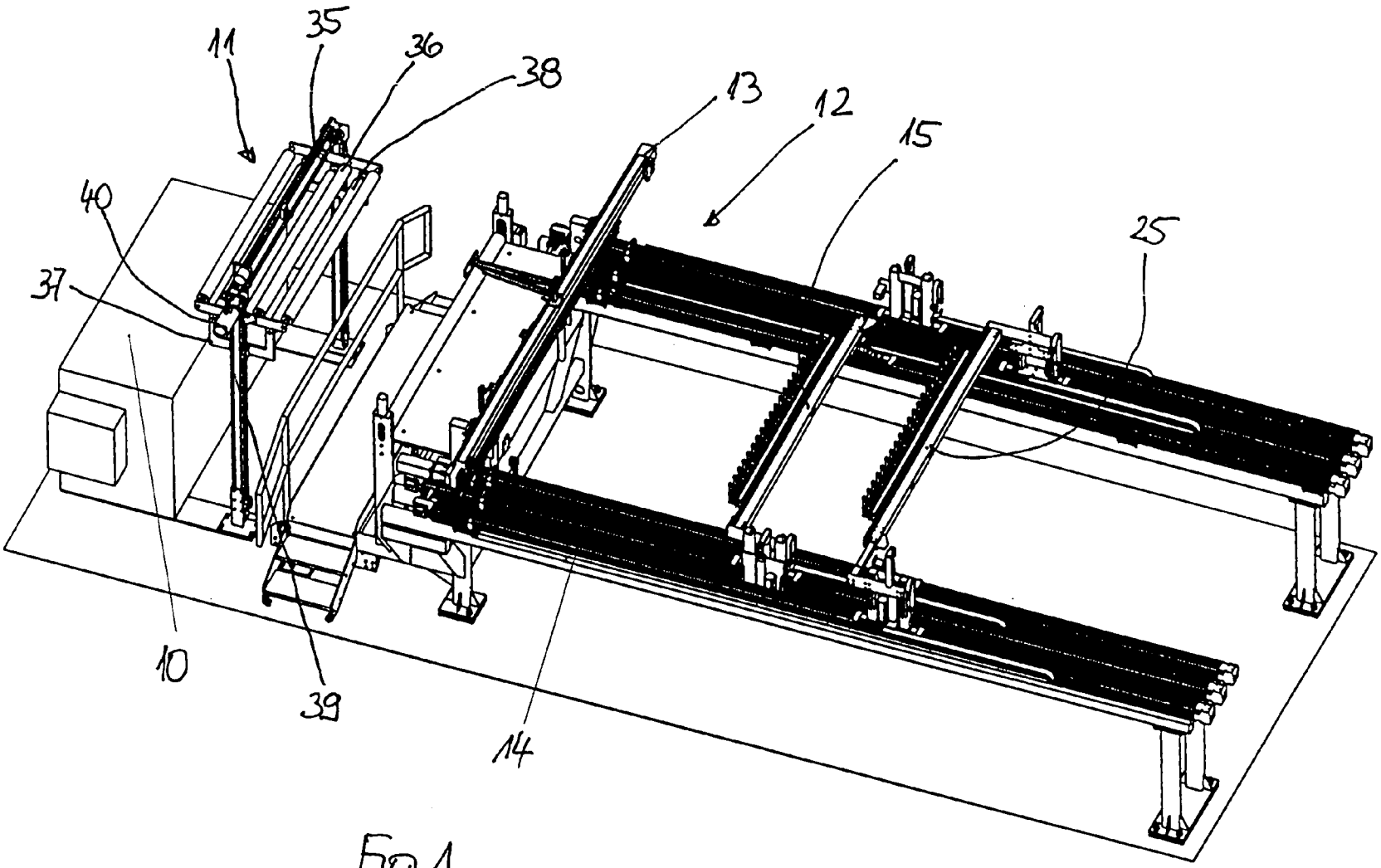
FIG. 1 is an overall view of a cutting installation.

The cutting installation depicted as a whole in FIG. 1 comprises an unwinding unit 10, which holds a supply of fabric web to be cut. In a manner not depicted, the unwinding unit, which provides a fabric web at a constant unwinding speed, guides this fabric web across a downstream dancer unit 11, which serves as a buffer and will be described separately below. From the dancer unit, the fabric web is guided to the downstream cutting frame 12, along which two gripper beams 15 and 25 are guided in laterally disposed rails 14. These gripper beams are adapted to grasp the end of the fabric web with pickup devices 16 and to bring it into the cutting position in which it is cut by the cutting unit 13. The cut part of the fabric web can be transported an additional distance by the respective gripper beam 15 or 25 grasping it and can be deposited on a stack (not depicted) located between the rails 14.

Figure 2:
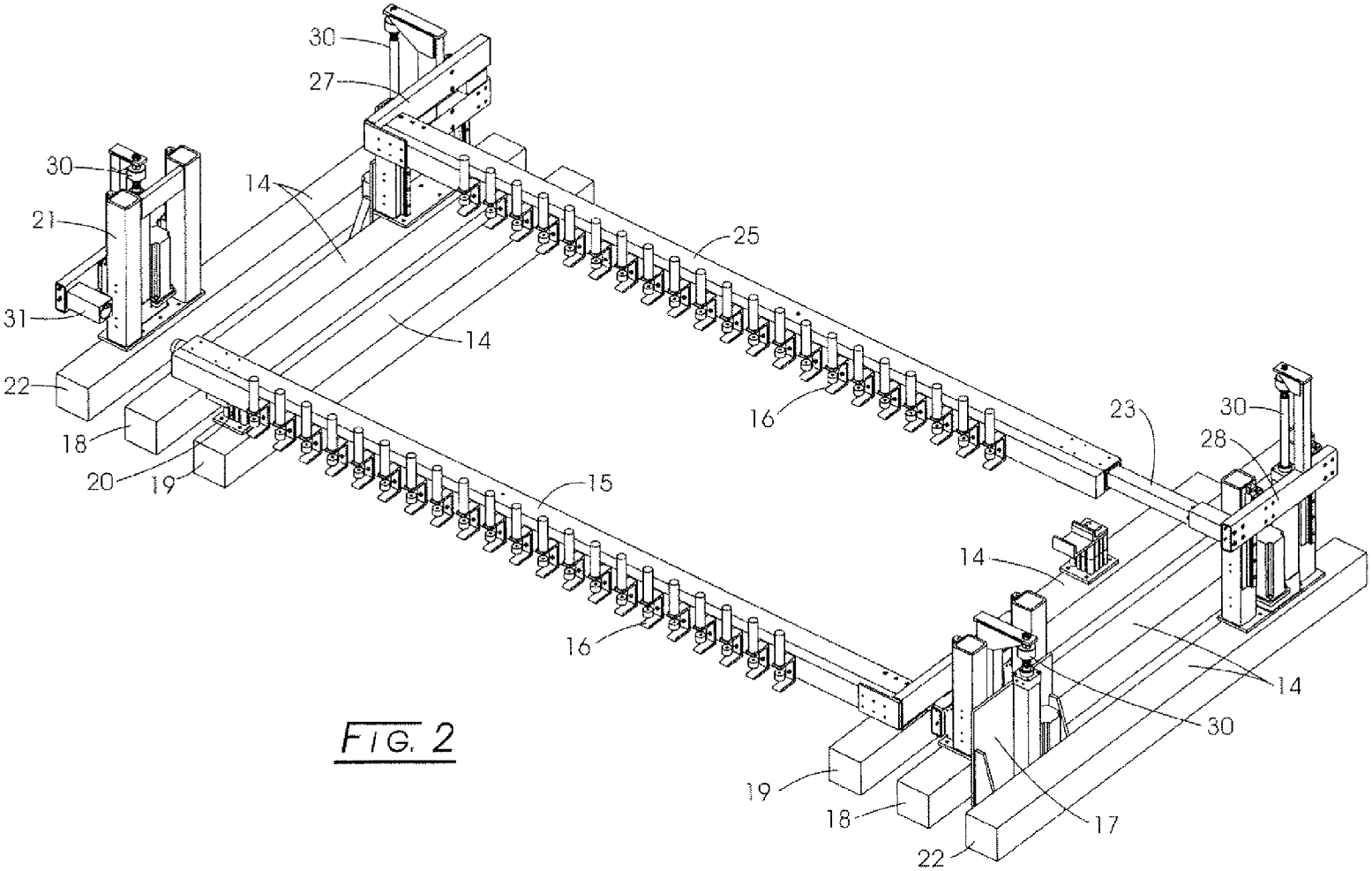
FIG. 2 shows a detail of the cutting table with the two displaceable gripper beams.

As shown in detail in FIG. 2, a first gripper beam 15 provided with a pickup device 16 is firmly mounted to and carried by a first support tower 17. This support tower is displaceable on a central rail 18 of three rails 14 arranged side by side. The first gripper beam 15 extends to the opposite rail arrangement 14 where it rests on a slide 20, which runs on the innermost rail 19 and is displaceable together with the first support tower 17. As shown in FIG. 2, the first gripper beam 15 is in its lowered, bottom position.

To enable the displacement according to the invention of two gripper beams along the cutting frame 12, a second gripper beam 25 is likewise mounted to and supported by a first support tower 27, which is guided along the center rail 18 of the rail arrangement 14. The arrangement of the first support tower 27 for the second gripper beam 25 is laterally reversed compared to the described arrangement of the first gripper beam 15 with the associated first support tower 17.

To enable a displacement of the second gripper beam 25 past the first gripper beam 15, the second gripper beam 25 can be put into a raised position by moving a lifting device 30 disposed on the first support tower 27 into its upper position. To create an end stop on the opposite side, a telescoping extension piece 23 is extended from the second gripper beam 25 and docks with a second support tower 28, which is displaceable on the outermost rail 22 of the rail arrangement 14. This second support tower 28 provides the same height-adjustment for the second gripper beam 25 as the first support tower 27. In this raised position, the end of the second gripper beam 25 facing away from the first support tower 27 carrying it is raised from the associated slide 20, which is displaced together with the second gripper beam 25. It is clear from FIG. 2 that the second gripper beam 25, in the depicted position, can be displaced over the first gripper beam 15. The first gripper beam 15 is also adapted for height adjustment, in that the first gripper beam 15 and its first support tower 17 located on the opposite side on the outermost rail 22 is in turn assigned a second support tower 21. The first gripper beam 15 can be docked with this second support tower 21 by means of an extension piece 23 (not depicted), which can be extended from the first gripper beam 15 to dock with the support tower 21. For this purpose, the second support tower 21 has a pin 31 protruding from it in axial direction of the gripper beam. The extension piece of the first gripper beam 15, which is provided with an associated recess, can be driven onto this pin. In this position, the lifting devices 30, located likewise on the first support tower 17 and the second support tower 21, provide the means to displace the first gripper beam 15 into its upper position.

The described mechanism makes it possible to displace the two gripper beams 15 and 25 independently from each other and without any mutual interference along the rail arrangement 14. As a result, while the one gripper beam 15 or 25 is in its cutting position, the respectively other gripper beam 15 or 25 can be moved to the front position on the cutting table 12, over the gripper beam held in its cutting or depositing position, so that after the cutting and depositing process it can immediately pick up the free end of the fabric web.

Because of the higher unwinding speed that is connected therewith, the dancer unit 11 according to FIG. 1 is also improved. This dancer unit 11 comprises, in a manner known per se, a dancer frame 35 in the upper region of which fixed deflection rollers 36 are arranged. In a slide 37, which can be displaced along the frame columns 39, movable deflection rollers 38 are arranged. As a result, the fabric web fed by the unwinding unit 10 is guided back and forth and thus looped between the fixed deflection rollers 36 and the movable deflection rollers 38, resulting in a buffer. To enable the adjustment of a defined input tension of the fabric web buffered in the dancer unit 11, the slide 37 is controllably displaceable along the frame columns 39 by a motor 40.

The configuration of the cutting installation according to the invention is of course not limited to a single fabric web. It is also possible to process several fabric webs simultaneously. In this case, several unwinding units and dancer units will have to be provided to feed several fabric webs. These several fabric webs can, for example, be grasped by the gripper beam in several layers one above the other, fed to and cut by the cutting unit in several layers and subsequently be deposited by the gripper beam.

The features of the subject of these documents, which are disclosed in the above description, the claims, the abstract and the drawing, can be essential for the implementation of the invention in its various embodiments either individually or in any combination thereof.

What is claimed is:

1. A cutting installation for a fabric web comprising an unwinding unit, a downstream dancer unit serving as a buffer, and a downstream cutting frame with a cutting unit disposed thereon, wherein at least two gripper beams extending parallel to the cutting unit and guided along a lateral rail arrangement are displaceable across the longitudinal extension of the cutting frame, and each gripper beam on one side is carried by a first support tower which is displaceable along the rails, and on its opposite end is provided with a telescopically extendable extension piece, which can be docked with a second support tower arranged on the opposite side and traveling along, and wherein the support towers are adapted for adjusting the height of the respectively carried gripper beam, such that each gripper beam, as it moves along the cutting frame, can travel over the other gripper beam.

2. The cutting installation as claimed in claim 1, wherein one gripper beam when in a lowered position, rests with its end opposite the first support tower carrying it on a slide that travels along.

3. The cutting installation as claimed in claim 1 wherein the first and second support towers and slides associated with each of the two gripper beams are arranged laterally reversed to each other on different sides of the cutting frame.

4. The cutting installation as claimed in claim 1, wherein three rails respectively, are arranged on the two sides of the cutting frame to receive, respectively, a first support tower, a second support tower and a slide.

5. The cutting installation as claimed in claim 4, wherein the slides are each displaceable on the innermost rails.

6. The cutting installation as claimed in claim 5, wherein the first support towers, each carrying the associated gripper beam, are displaceable on the center rails.

7. The cutting installation as claimed in claim 6, wherein the second support towers, each adapted to dock with the extension piece of the gripper beams, are displaceable on the outermost rails.

8. The cutting installation as claimed in claim 1, wherein the first and second support towers each have a lifting device for moving the gripper beam carried by them between a lowered position and a raised position.

9. The cutting installation as claimed in claim 1, wherein the second support towers and/or the ends of the extendable extension pieces have a docking device for a detachable connection of the support towers and the extension pieces.

10. The cutting installation as claimed in claim 9, wherein the respective second support tower has a pin protruding in axial direction of the gripper beam and serving as a docking device, onto which can be driven the respective extension piece of the gripper beam, which is provided with a bore at its end.

11. The cutting installation as claimed in claim 1 further including a number of fixed first deflection rollers and a number of second deflection rollers supported on a displaceably arranged slide opposite the fixed deflection rollers, wherein the movable slide with the second deflection rollers can be displaced by means of a motor, and a controlled input tension of the fabric web running across the first and the second deflection rollers can be adjusted.

* * * * *